US005863226A

United States Patent [19]

Lan et al.

[11] Patent Number: 5,863,226

[45] **Date of Patent: *Jan. 26, 1999**

[54] CONNECTOR FOR COAXIAL CABLE

[76] Inventors: Cheng Sun Lan; Shen-Chia Wong, both of No. 10, Lane 121, Li-Der Rd., Peito District, Taipei, Taiwan

[ * ] Notice: The term of this patent shall not extend beyond the expiration date of Pat. No. 5,667,409.

[21] Appl. No.: 711,899

[22] Filed: Sep. 12, 1996

Related U.S. Application Data

[63] Continuation-in-part of Ser. No. 579,214, Dec. 28, 1995, Pat. No. 5,667,409.

[51] Int. Cl.[6] ..... H01R 11/22

[52] U.S. Cl. ..... 439/852; 439/654; 439/578

[58] Field of Search ..... 439/575, 578, 439/651, 654, 655, 675, 852

[56] References Cited

U.S. PATENT DOCUMENTS

| | | | |
|---|---|---|---|
| 3,571,783 | 3/1971 | Lusk | 439/578 |
| 4,456,324 | 6/1984 | Staeger | 439/578 |
| 4,971,578 | 11/1990 | Wilson | 439/578 |
| 5,096,444 | 3/1992 | Lu et al. | 439/578 |
| 5,498,175 | 3/1996 | Yeh et al. | 439/578 |
| 5,529,522 | 6/1996 | Huang | 439/578 |
| 5,667,409 | 9/1997 | Wong et al. | 439/578 |

*Primary Examiner*—Paula Bradley
*Assistant Examiner*—Tho Dac Ta
*Attorney, Agent, or Firm*—Pro-Techtor International Services

[57] ABSTRACT

A connector for coaxial cable, including a main body formed with an inner passage in which a pair of insulative sleeves are fitted. Each insulative sleeve is disposed with a small diameter section. A tubular contact member is fitted between the small diameter sections of the two insulative sleeves. The contact member is made of a sheet material by means of curling. Two ends of the contact member are not adjoined together so as to define a narrow slit. An opposite side of the slit is also formed with two slits which are not adjacent to each other so that when a core with 1.2 to 1.3 mm diameter is inserted into the contact member, the contact member is stretched open to achieve greater resilience.

6 Claims, 8 Drawing Sheets

CONNECTOR FOR COAXIAL CABLE

CROSS-REFERENCE OF THE APPLICATION

The present application is a continue-in-part application of U.S. patent application Ser. No. 08/579,214 which is now U.S. Pat. No. 5,667,409, filed Dec. 28, 1995.

BACKGROUND OF THE INVENTION

The present invention relates to an improved connector for coaxial cable in which a tubular contact member and an insulative sleeve are connected with each other for reducing back loss of the electrical appliance. The connector is suitable for coaxial cables with different specifications.

U.S. patent application Ser. No. 08/579,214 provides a connector for improving the conventional connector for coaxial cable used in the existing cable TV system, closed-circuit TV system and common antenna TV system. The conventional connector includes internal flat contact plate and insulative member. When the core of the cable is inserted into the connector, the core contacts with the contact plate only at an upper and a lower points with poor contacting effect so that the back loss of the electrical appliance is greater and the requirement of high frequency cannot be satisfied. Especially, when the cable TV is connected with a telephone, the cable needs to receive the input signal (such as the selected TV program and TV purchase item) from the TV end as well as provide the current for the telephone ring sound simultaneously. At this time, the core of the cable bears greater current. With respect to the contacting point of the conventional connector, when greater current passes therethrough, the poor contact will result in sparks. This makes the transmitted signal and current unable to effectively pass through the contact point. Accordingly, the quality of the telephone transmission cannot be accurately controlled.

In order to solve the above problem, U.S. patent application Ser. No. 08/579,214 provides a cylindrical contact member instead of the flat contact member for eliminating the problems of impedance coupling in high frequency and the compatibility of different cables so as to achieve better contacting effect, permitting greater current to pass through the connector.

However, in use, it is found that when a core with over 1.2 mm diameter is inserted into the tubular contact member, the.contact member is subject to failure of resilience. Moreover, the plastic-made insulative sleeve has poor waterproof effect.

SUMMARY OF THE INVENTION

It is therefore a primary object of the present invention to provide an improved connector for coaxial cable, in which the tubular contact member is made of a sheet material by means of curling. Two ends. of the contact member are not adjoined together so as to define a narrow slit. An opposite side of the slit is also formed with two slits which are not adjacent to each other so that a core with over 1.2 mm diameter is suitable for the contact member without failure of resilience of the material and with greater resilience.

It is a further object of the present invention to provide the above connector in which the insulative sleeve has a short structure for greatly enhancing the electrical property and reduce back loss of the electrical appliance.

It is still a further object of the present invention to. provide the above connector in which the small diameter section of the insulative sleeve is formed with several slits, permitting the small diameter section to expand so as to increase contacting effect and reduce contacting impedance.

The present invention can be best understood through the following description and accompanying drawing, wherein:

DETAILED DESCRIPTION OF THE PREFERRED EMBODIMENTS

Figure 1:
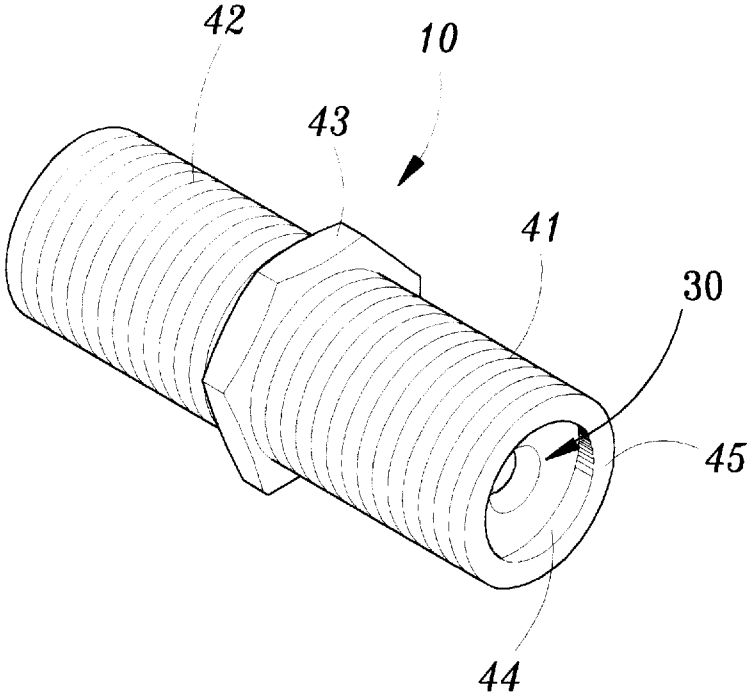
FIG. 1 is a perspective assembled view of a first embodiment of the present invention.
Figure 2:
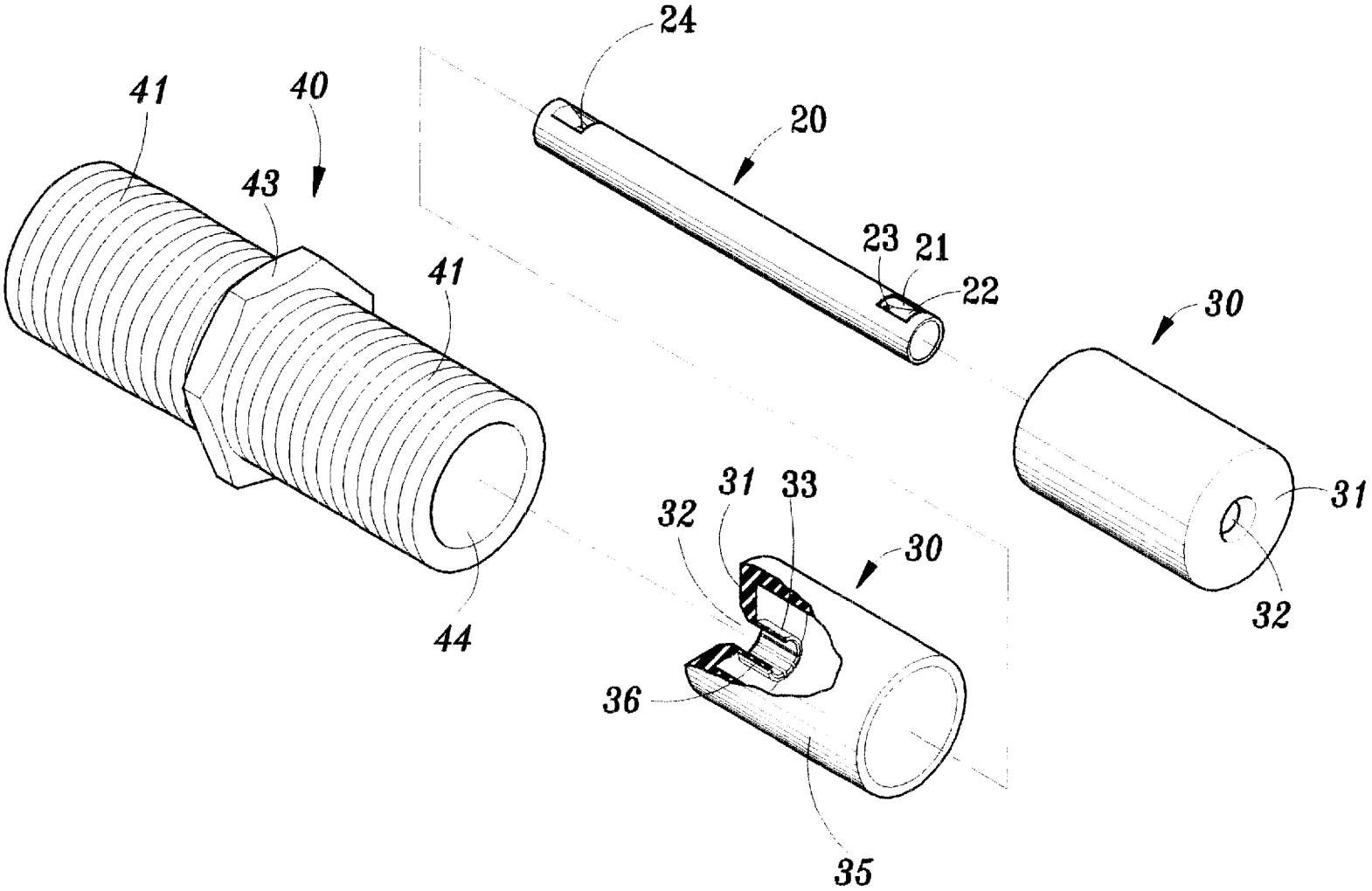
FIG. 2 is a perspective exploded view according to FIG. 1.

Please refer to FIGS. 1 and 2. The connector of the present invention includes a main body 40 having a nut section 43 at middle portion of outer surface and two thread sections 41, 42 on two sides of the nut section 43. The main body 40 is formed with an inner passage 44 in which a pair of insulative sleeves 30 are fitted. The outer circumferential face 35 of the insulative sleeve 30 is engaged with the wall of the passage 44. One end face 31 of each insulative sleeve 30 is disposed with a small diameter section 33 inward extending from the end face 31. The small diameter section 33 is formed with several slits 36, permitting the small diameter section 33 to be expanded. A contact member 20 is fitted between the small diameter sections 33 of the two insulative sleeves 30. The end face 31 of the insulative sleeve 30 is formed with a central through hole 32. The small diameter section 33 is concentric with and extends inward from the peripheral wall of the central through hole 32. The inner wall of the small diameter section 33 is disposed with slope face 34, whereby the contact member 20 can be easily fitted into the small diameter section 33. In this embodiment, the insulative sleeve 30 has an elongated structure.

The contact member 20 is punched with at least two rectangular holes 21 near two ends respectively. One end of the rectangular hole .21 is connected with the tube body of the contact member 20 to form an inward extending inclined section 22 and arch section 23. The arch section 23 is formed with a fissure 24 for increasing the contact area with a contact article.

Figure 3:
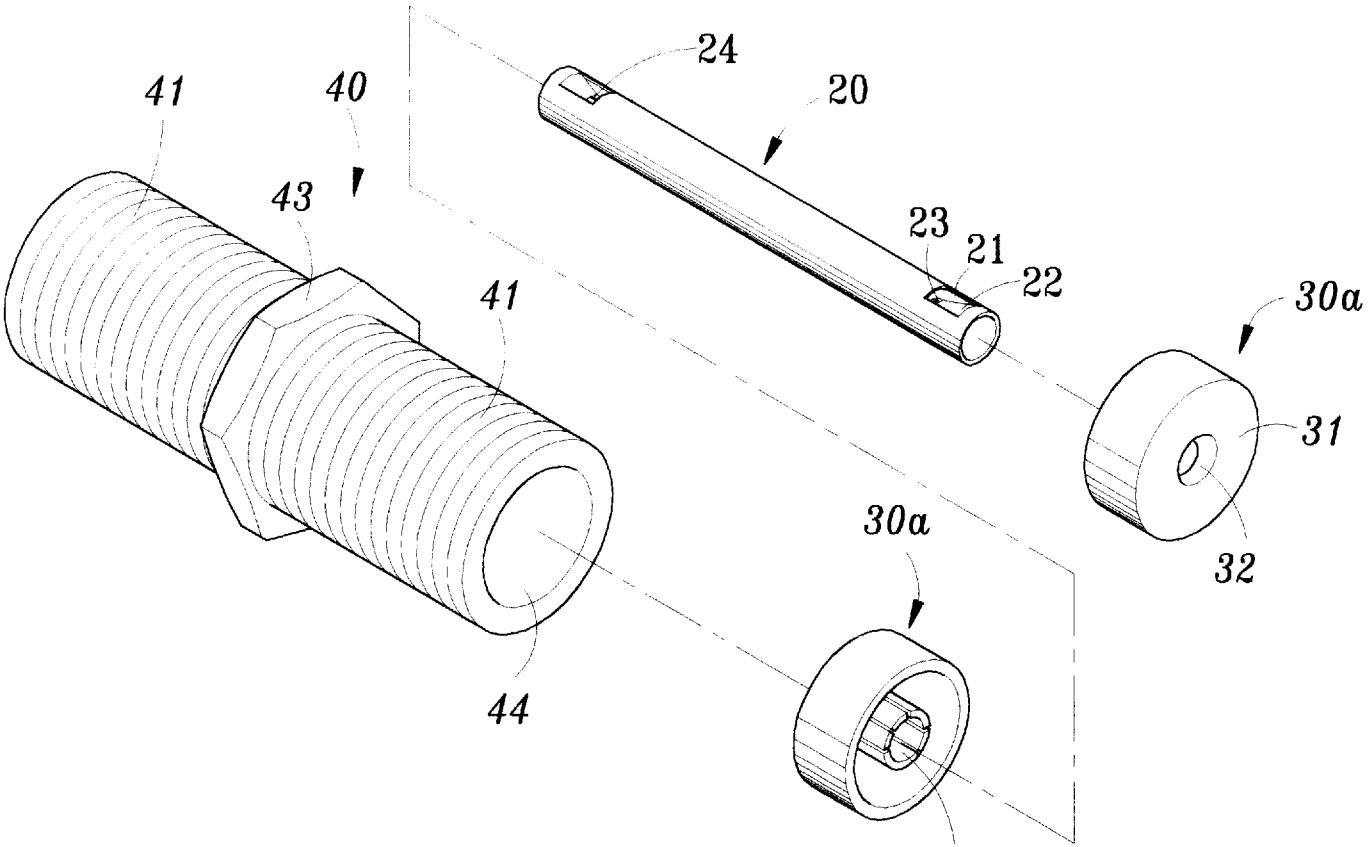
FIG. 3 is a perspective exploded view of a second embodiment of the present invention.
Figure 4:
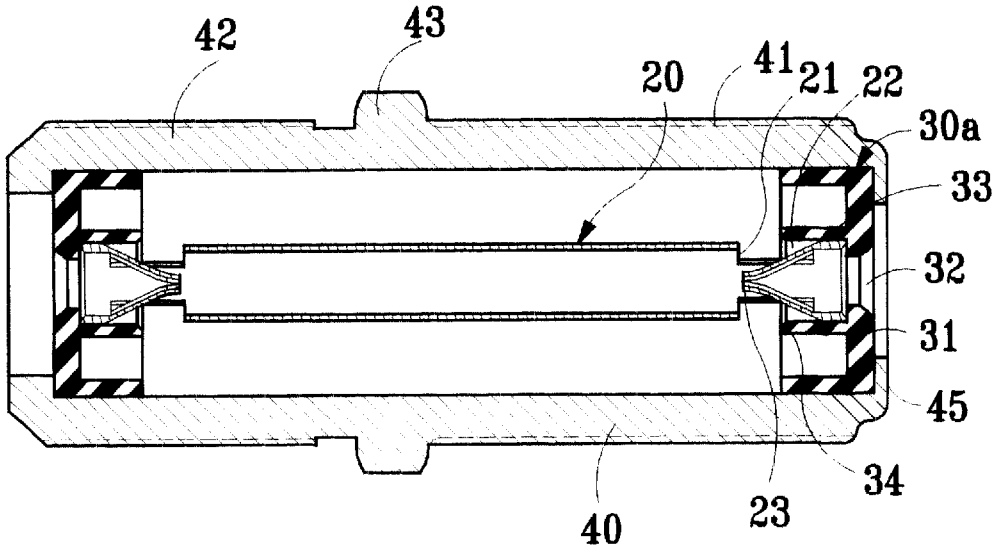
FIG. 4 is a sectional view according to FIG. 3.

FIGS. 3 and 4 show another embodiment of the present invention, wherein the insulative sleeve 30*a* has a short structure and is located at each end of the passage 44 of the main body 40 without contacting with each other. According to a test result, the short structure is able to achieve a better electrical property and greatly reduce back loss of the electrical appliance.

Figure 5:
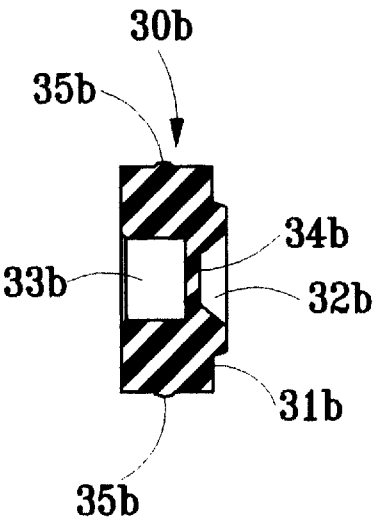
FIG. 5 is a sectional view of a third embodiment of the insulative sleeve of the present invention.

FIG. 5 shows a third embodiment of the present invention, wherein the insulative sleeve 30*b* is made of rubber material and formed with a central recess 32*b* on outer end face 31*b*. The insulative sleeve 30*b* is further formed with a coaxial insertion hole 33*b* for the contact member 20 to fit therein. An annular projection 35*b* is disposed on the outer circumference of the insulative sleeve 30*b*. A membrane 34*b* is disposed between the central recess 32*b* and the insertion hole 33*b*. The annular projection 35*b* and the membrane 34*b* serve to achieve a better waterproof effect for the interior of the connector and increase the resilience of the contact member 20. When coupled with the core of the cable, by means of slightly forcing the cable, the core can pierce the membrane 34*b* to engage with the contact member 20.

Figure 6:
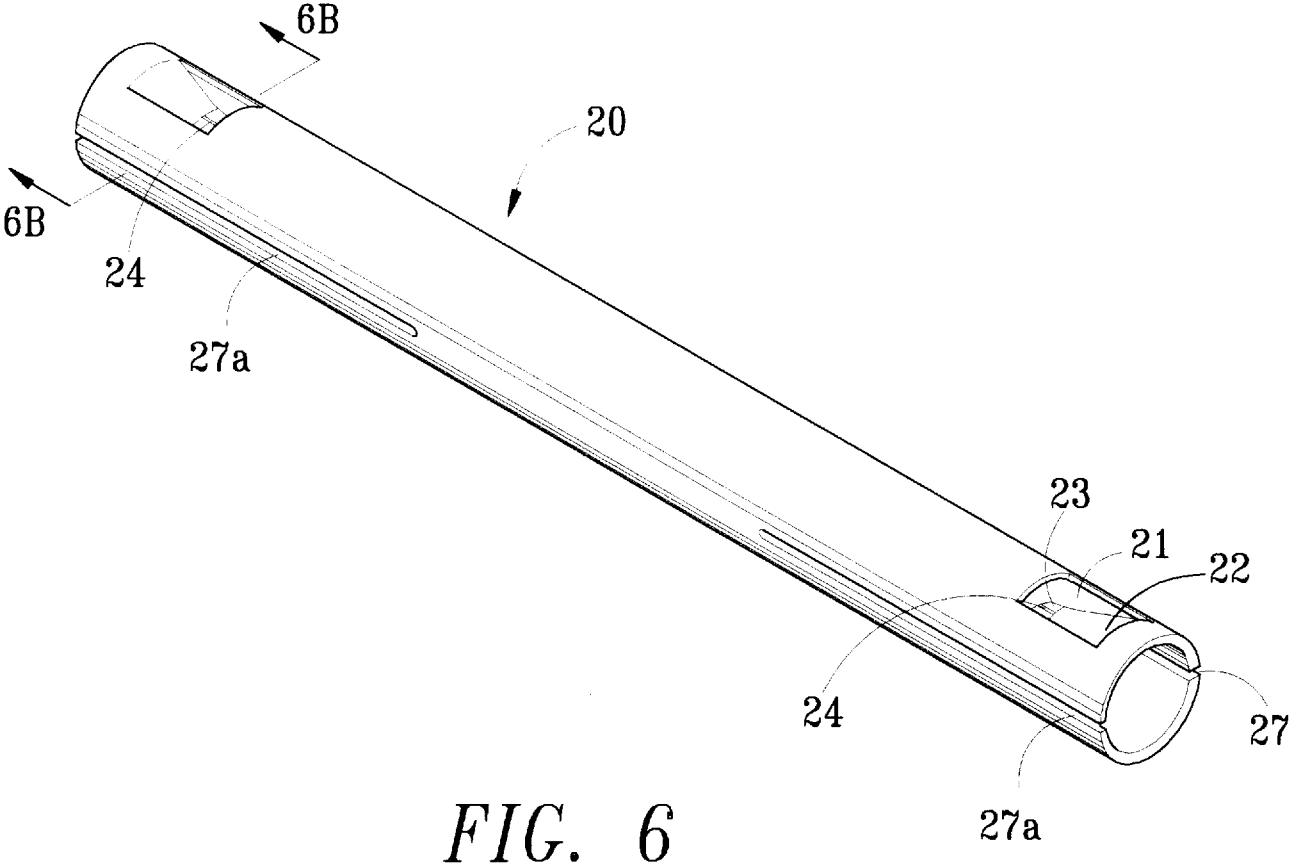
FIG. 6 is a perspective view of a fourth embodiment of the contact member of the present invention.
Figure 6B:
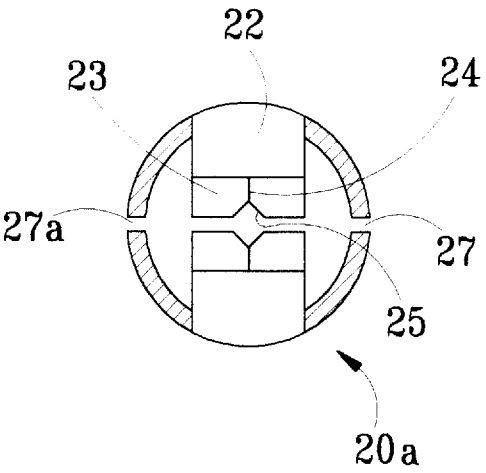
FIG. 6B is a sectional view taken along line 6A—6A of FIG. 6.
Figure 6A:
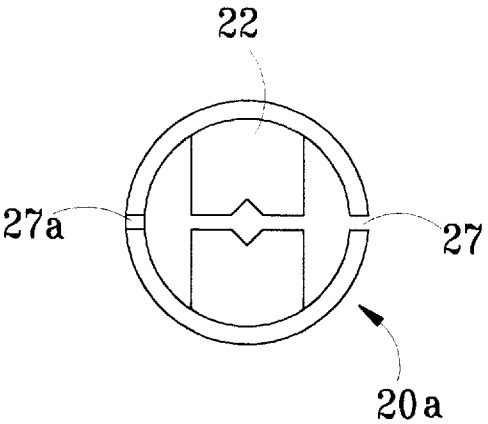
FIG. 6A is a right side view according to FIG. 6.

FIGS. 6, 6A and 6B which show a fourth embodiment, wherein the contact member 20*a* is made of a sheet material by means of curling. Two ends of the contact member 20*a* are not adjoined together so as to define a narrow slit 27. The opposite side of the slit 27 is also formed with two slits 27*a* which are not adjacent to each other. This contact member 20*a* is adapted to a core with a diameter of over 1.2 mm. When a 1.2 to 1.3 mm core is inserted, by means of the slits 27, 27*a*, the contact member 20*a* can be stretched open to achieve greater resilience.

Figure 7B:
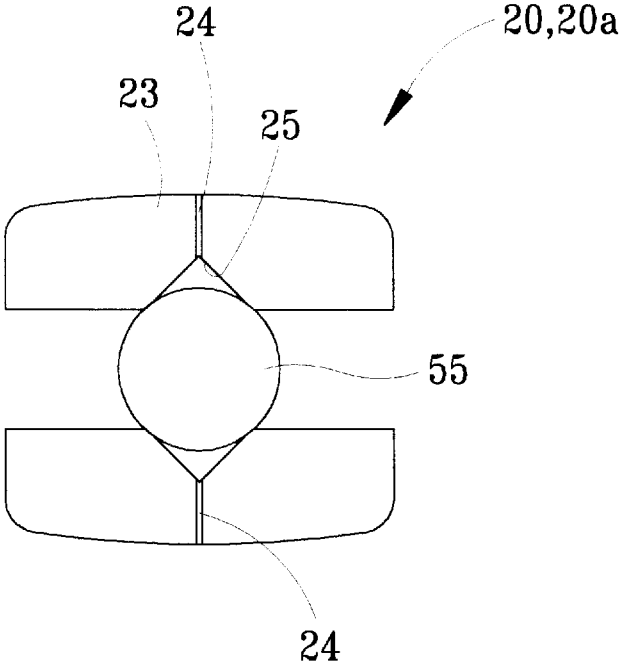
FIG. 7B shows that a core with larger diameter is inserted into the arch sections of the contact member of the present invention.
Figure 7A:
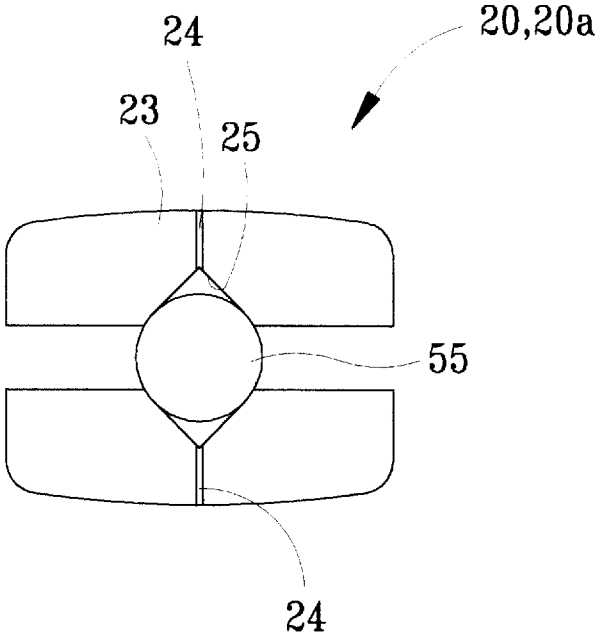
FIG. 7A shows that a core with less diameter is inserted into the arch sections of the contact member of the present invention.

Please refer to FIGS. 7A and 7B. When the core 55 is inserted into the contact member 20 or 20*a*, the arch sections 23 as well as the inclined sections 22 are outward stretched open. In the case of a smaller core, the engagement between the core and the contact member is as shown in FIG. 7A. In the case of larger core, the engagement between the core and the contact member is as shown in FIG. 7B. The bottom of the arch section 23 is disposed with a V-shaped notch 25 and a fissure 24 so that the inserted core contacts with the contact member along a line.

Figure 8:
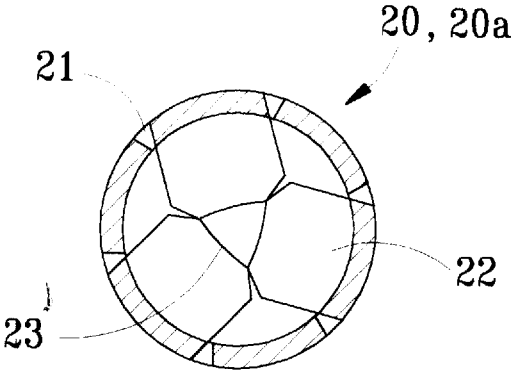
FIG. 8 is a sectional view showing that each end of the contact member is punched with three rectangular holes.

The insulative sleeve 30, 30*a*, 30*b* of the present invention can be selectively made of plastic or rubber material to achieve a better strength and waterproof effect. The suitable dimension of the core of the cable is within 0.5 to 1.2 mm. (The existing core of the coaxial cable is within about 0.6 to 1.05 mm.) This is advantageous over the conventional one. In case the diameter of the insulative sleeve is enlarged, the same connector is suitable for larger core, In FIG. 8, each end of the contact member 20 is punched with three rectangular holes 21.

According to the above arrangement, the present invention is advantageous over the conventional device in that;

The ratio of defective product is greatly reduced and the electrical property is enhanced. In addition, the core contacts with the contact member along a line or on a face, whereby the back loss of the electrical appliance is less and the range of the suitable core is larger (0.5 to 1.3 mm) for greater current to pass therethrough.

It is to be understood that the above description and drawings are only used for illustrating one embodiment of the present invention, not intended to limit the scope thereof. Any variation and derivation from the above description and drawings should be included in the scope of the present invention.

What is claimed is:

1. A connector for coaxial cable comprising:

a main body with an inner passage, a pair of insulating sleeves fitted inside said inner passage, an outer end face of each insulating sleeve includes a small diameter section, a tubular contact member being fitted between said small diameter sections of said insulating sleeves, each end of said contact member includes at least two rectangular holes on upper and lower sides respectively, each rectangular hole includes a lower side formed by an inward extending inclined section of said contact member, said inclined section includes at an inner end thereof an arch section; wherein said contact member is formed from a single sheet of material rolled into a tubular body, ends of said contact member are not joined so that a narrow first slit is defined between said ends, said contact member includes a second slit on a side of said contact member opposite said first slit, said second slit does not extend the entire length of said contact member so that said contact member remains a single piece, said first slit and said second slit allow expansion of said contact member.

2. The connector as claimed in claim 1 wherein:

said small diameter section of said insulating sleeve includes a plurality of slits.

3. A connector as claimed in claim 1, wherein the insulative sleeve has a short structure.

4. A connector as claimed in claim 1, wherein at least two rectangular holes are punched on each end of the contact member.

5. A connector as claimed in claim 1, wherein the insulative sleeve is made of rubber material and formed with a central recess on outer end face, the insulative sleeve being further formed with a coaxial insertion hole for the contact member to fit therein, a membrane being disposed between the central recess and the insertion hole for achieving a better waterproof effect for the interior of the connector and increasing the strength of the contact member.

6. A connector as claimed in claim 5, wherein an annular projection is disposed on outer circumference of the insulative sleeve for achieving double waterproof effect.

* * * * *